US006866122B2

(12) United States Patent
Brozovic

(10) Patent No.: US 6,866,122 B2
(45) Date of Patent: Mar. 15, 2005

(54) DRAIN VALVE

(75) Inventor: Darko Brozovic, Richmond Hts., OH (US)

(73) Assignee: Fluid Line Products, Inc., Willoughby, OH (US)

( * ) Notice: Subject to any disclaimer, the term of this patent is extended or adjusted under 35 U.S.C. 154(b) by 146 days.

(21) Appl. No.: 10/264,235

(22) Filed: Oct. 3, 2002

(65) Prior Publication Data

US 2004/0065509 A1 Apr. 8, 2004

(51) Int. Cl.[7] ..... F16L 29/02; F16L 37/32
(52) U.S. Cl. ..... 184/1.5; 251/149.4
(58) Field of Search ..... 184/1.5, 80, 82; 251/149.4; 123/196 A, 196 R, 196 S

(56) References Cited

U.S. PATENT DOCUMENTS 4,002,186 A * 1/1977 Fink et al. ..... 137/614.03
4,386,639 A * 6/1983 Gable et al. ..... 141/351
4,530,421 A * 7/1985 Balch ..... 184/1.5
4,745,894 A * 5/1988 Laipply et al. ..... 123/196 R
5,048,578 A * 9/1991 Dorf et al. ..... 141/346
5,228,647 A * 7/1993 Ruibal Santome ..... 251/149.4
5,667,195 A * 9/1997 McCormick ..... 251/149.6
6,135,150 A * 10/2000 Powell et al. ..... 137/614.04
6,199,578 B1 * 3/2001 Clark, II ..... 137/318
6,234,274 B1 * 5/2001 van der Griendt ..... 184/105.3
6,655,498 B1 * 12/2003 Sasa et al. ..... 184/1.5
2003/0070876 A1 * 4/2003 Takahara ..... 184/1.5

* cited by examiner

*Primary Examiner*—Chong H. Kim
(74) *Attorney, Agent, or Firm*—Fay, Sharpe, Fagan, Minnich & McKee, LLP

(57) ABSTRACT

A drain valve for mounting as a replacement for the drain plug in the oil pan of a motor vehicle includes a body member having an upstream end threaded for attachment to the oil pan, a downstream end, and a passageway therethrough normally closed by a valve element adjacent the downstream end thereof. A valve actuator is mountable on the downstream end of the body member to displace the valve element to open the passageway, and the downstream end of the actuator receives a drain hose for directing the oil to a collection receptacle. A dust cap covers the downstream end of the valve between draining operations to protect the valve from damage.

38 Claims, 3 Drawing Sheets

DRAIN VALVE

BACKGROUND OF THE INVENTION

This invention relates to the art of valves and, more particularly, to a selectively operable valve for draining a liquid from a reservoir.

The present invention has particular utility in connection with draining oil from the engine of a motor vehicle and, accordingly, the drain valve of the invention will be disclosed and described in detail with regard to such use. At the same time, however, it will be appreciated that a drain valve in accordance with the invention can be used for draining liquids other than oil and draining liquids from a reservoir other than that provided by the oil pan of a motor vehicle.

It is of course well known that the changing of oil in a motor vehicle requires the removal of a drain plug from the oil pan beneath the vehicle engine. The oil plug is a threaded component and removal thereof is initiated by means of a wrench and generally is completed by a mechanic or do-it-yourself vehicle owner by manually unscrewing the plug from the oil pan. Most often, oil begins to bypass the plug prior to its complete removal from the oil pan and such bypass results in the oil flowing onto the person's hands and/or clothing and then impinging against the collection receptacle which may include a funnel positioned beneath the drain opening in the oil pan. Such impingement against the funnel or other receptacle can result in splashing of the oil onto the person performing the draining operation and/or onto the floor or other surface underlying the vehicle. Further, other spillage often results from the person attempting to minimize his or her exposure to the oil by jerking his or her hand from the drain plug as soon as it is freed from the oil pan. In any event, any oil which ends up on the floor beneath the vehicle is potentially hazardous in that it makes the floor slippery, and is somewhat contaminating in nature in that it can be absorbed into the floor surface and accumulate dirt and other foreign matter. Moreover, used oil is salable and/or reusable, and the oil which ends up on the floor and/or on the person servicing the vehicle is lost for the latter purpose. Still further, the oil which ends up on the person's hands and arms is messy to deal with, and the effort required to clean-up the floor area, the person's hands and arms and clothing is both inconvenient and time-consuming.

SUMMARY OF THE INVENTION

The present invention provides a drain valve for the oil reservoir of a vehicle by which the foregoing and other problems encountered in draining an oil reservoir by removal of a drain plug are advantageously minimized or overcome. More particularly in this respect, the present invention provides a drain valve adapted to replace the oil drain plug on existing vehicles and to be used as original equipment in connection with the manufacturer of motor vehicles. The drain valve has an upstream end for connection with the oil drain port of a vehicle, such as is commonly provided in the oil pan beneath the vehicle engine, and a downstream end which is normally closed and which is adapted to be opened by a person in a manner which avoids the uncontrolled release of oil resulting from unscrewing the standard drain plug. Preferably, such opening of the valve is achieved through the use of an actuator in the form of a coupling which is adapted to be attached to the downstream end of the valve and which, during such attachment, opens the valve for the flow of oil therethrough. The actuator includes an outlet opening through which the oil flows and the actuator is adapted to be mounted on the downstream end of the valve in a manner whereby the flow of oil therethrough is controlled so as to preclude flow onto the hands of the person operating the valve and splattering of the oil onto the person and/or into the environmental area around and adjacent the draining operation. The drain valve advantageously provides environmentally safe oil draining processes, avoids the loss of salable or reusable oil, avoids or minimizes the cost of clean-up both of the environment and the user's hands and clothing. Still further, the drain valve is easy to use and is user friendly for the foregoing reasons.

It is accordingly an outstanding object of the present invention to provide a manually operable liquid drain valve for draining liquid from a liquid reservoir in a motor vehicle.

A further object is the provision of a valve of the foregoing character which enables the draining of liquid without loss thereof.

Another object is the provision of a valve of the foregoing character which enables draining of the reservoir without spillage of the liquid onto the person performing the draining operation and/or onto surfaces and objects adjacent to or beneath the draining point.

Yet another object is the provision of a valve of the foregoing character which enables the draining of liquid from a vehicle reservoir in a manner which is environmentally safe and clean.

Still a further object is the provision of a valve of the foregoing character which is easy to use and which minimizes or avoids the cost of and the time required to clean, the hands and clothing of a person draining fluid from a vehicle and to clean the area in which draining takes place.

Still another object is the provision of a valve of the foregoing character which can be installed in the outlet opening of a liquid reservoir in a vehicle as a replacement for the existing drain plug or as an alternative to the drain plug in connection with the manufacture of a vehicle.

DESCRIPTION OF THE DRAWINGS

The foregoing objects, and others, will in part be obvious and in part pointed out more fully hereinafter in connection with the written description of a preferred embodiment of the invention illustrated in the accompanying drawings in which.

DESCRIPTION OF A PREFERRED EMBODIMENT

Figure 1:
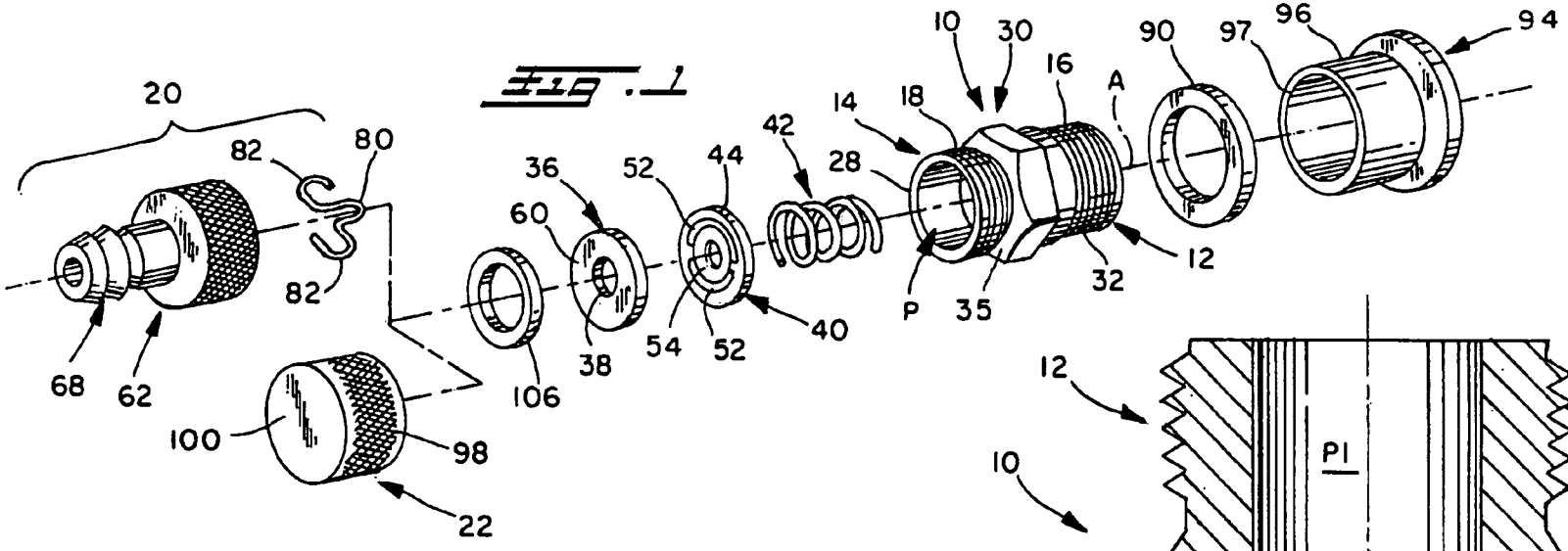
FIG. 1 is an exploded perspective view of the component parts of a drain valve in accordance with the invention and showing valve actuator and protective cap components therefor.
Figure 2:
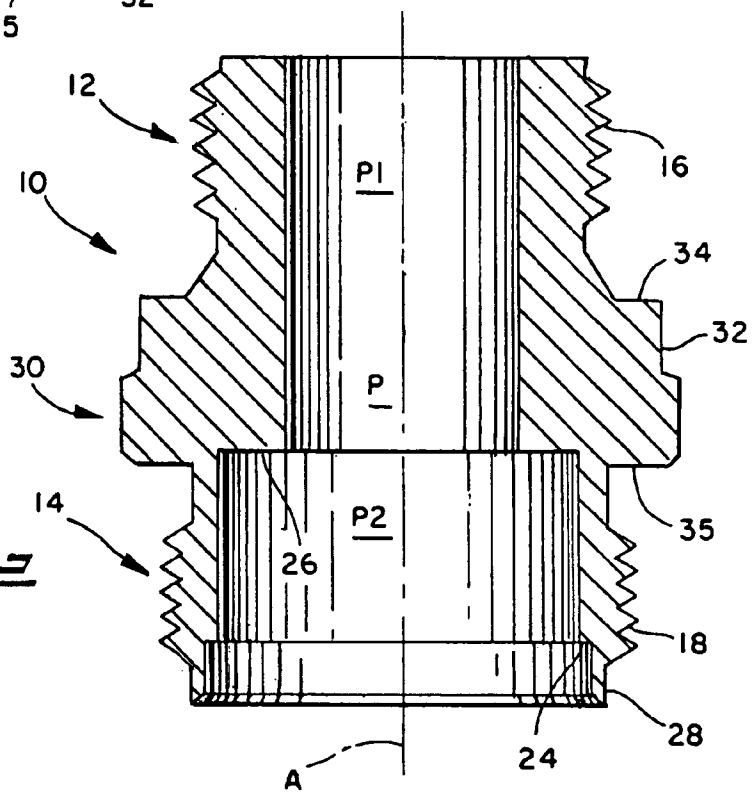
FIG. 2 is a sectional elevation view of the body member of the drain valve.
Figure 3:
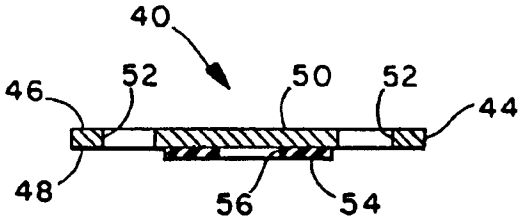
FIG. 3 is a sectional elevation view of the valve element of the drain valve.

Referring now in greater detail to the drawings, wherein the showings are for the purpose of illustrating a preferred embodiment of the invention and not for the purpose of limiting the same, a drain valve in accordance with the invention includes a body member 10, preferably of low carbon steel, having an axis A and upstream and downstream ends 12 and 14, respectively. A circular passageway P extends through body member 10 and has upstream and downstream ends P1 and P2, respectively. The upstream end of body member 10 is provided with external threads 16 for threaded interengagement with internal threads on the drain outlet of an oil reservoir in a vehicle, such as an oil pan, and the downstream end of the body member is provided with external threads 18 for selectively receiving one of an internally threaded valve actuator 20 and protective end cap 22, each in the manner and for the purpose set forth hereinafter. As best seen in FIG. 2, passageway P includes a first radially inwardly extending shoulder 24 at the downstream end thereof and facing in the downstream direction, and a second radially inwardly extending shoulder 26 intermediate the upstream and downstream ends thereof and facing in the downstream direction. Body 10 terminates at the downstream end thereof in an annular skirt 28 which extends about shoulder 24 and serves the purpose set forth hereinafter. A tool pad 30, such as a hexagonal wrench pad, extends about body member 10 intermediate the upstream and downstream ends thereof, and a cylindrical surface portion 32 of the body member extends upstream from pad 30 and provides a radially outwardly extending shoulder 34 facing in the upstream direction. As will be described more fully hereinafter, the downstream side 35 of tool pad 30 and shoulder 34 function as sealing surfaces in connection with the mounting and use of the drain valve.

Figure 4:
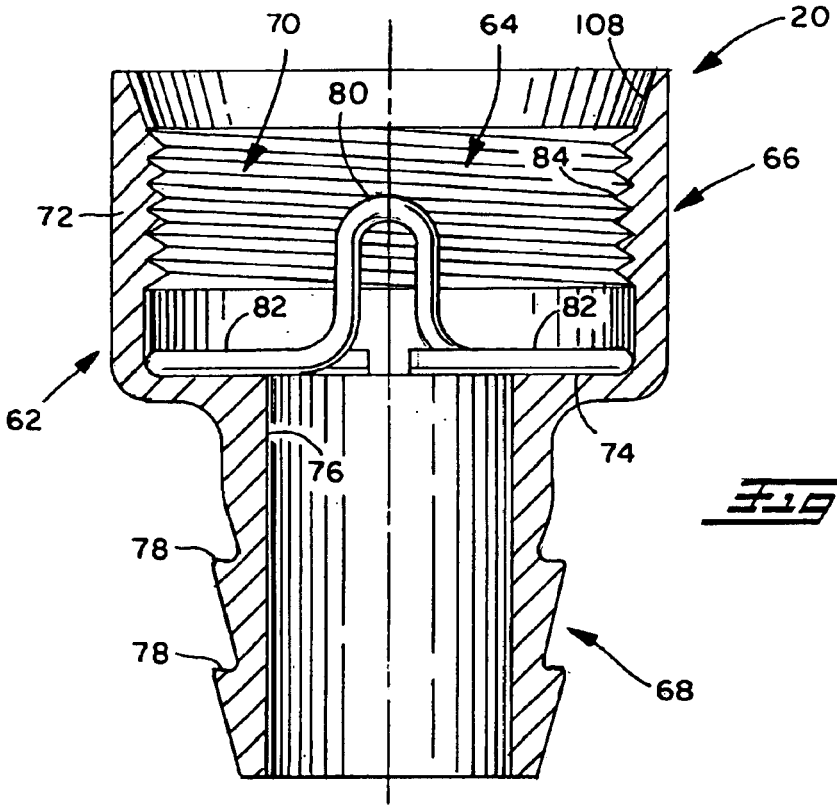
FIG. 4 is a sectional elevation view of the valve actuator.

The drain valve further comprises a valving assembly including a circular valve seat plate 36, preferably of stainless steel and having an aperture 38 therethrough, a valve element 40 and a biasing spring 42, preferably of piano wire. As best seen in FIG. 4, valve element 40 includes a circular disk 44 which is preferably of stainless steel and has upstream and downstream sides 46 and 48, respectively. Further, disk 44 has a central portion 50 and diametrically opposed, circumferentially extending arcuate slots 52 radially outwardly of central portion 50 and extending through the disk. Further, the downstream side of disk 44 is provided with an annular ring 54 of a suitable resilient sealing material such as rubber, Viton, Neoprene, or the like. Ring 54 provides an opening 56 to the downstream side of disk 44 for the purpose which will become apparent hereinafter, and the outer periphery of ring 54 is radially inwardly adjacent the inner edges of arcuate slots 52.

Figure 5:
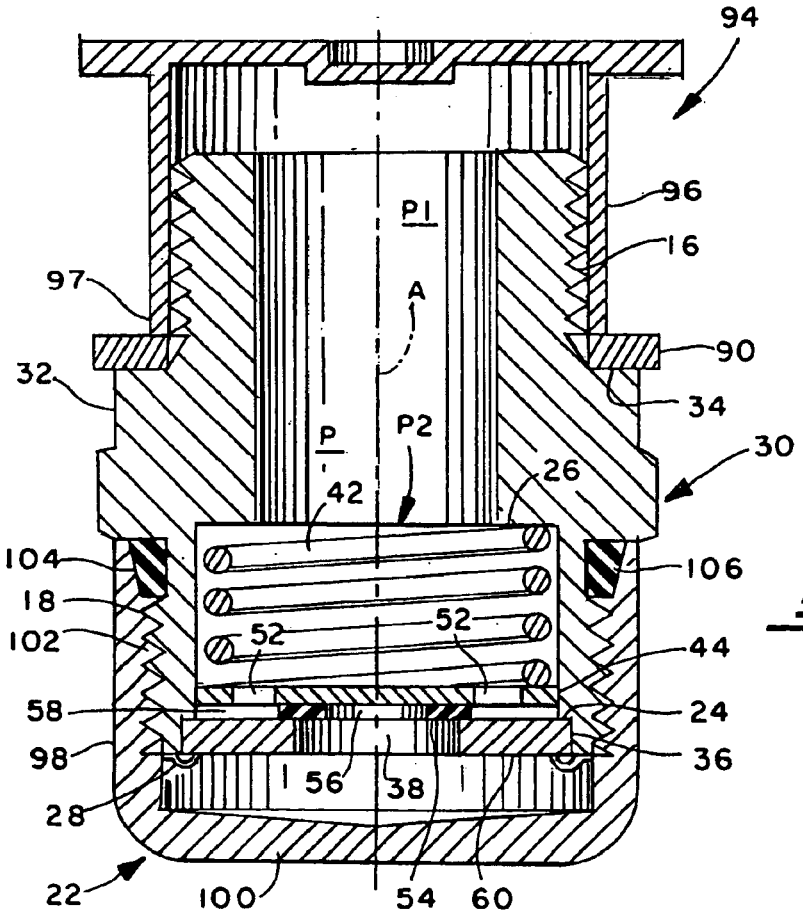
FIG. 5 is a sectional elevation view of the valve prior to installation and showing protective caps thereon; and, FIG. 6 is a sectional elevation view of the valve mounted in an oil opening and showing the valve actuator operatively mounted thereon.

As best seen in FIG. 5, the valving assembly is received in downstream end P2 of passageway P and is retained therein by engaging the upstream side 58 of seat plate 36 against shoulder 24 and rolling annular skirt 28 inwardly across the peripheral edge of seat plate 36 on the downstream side 60 thereof. Spring 42 engages between shoulder 26 and the periphery of valve disk 44 radially outwardly of slots 52 to bias the valve disk and thus sealing ring 54 against the upstream side of seat plate 36 about opening 38 therethrough to provide the closed position for the valve. By pushing valve disk 44 in the upstream direction against the bias of spring 42, the valve disk and sealing element 54 are displaced away from valve plate 36 to provide the open position of the valve.

Displacement of valve disk 44 to the open position is preferably achieved through the use of actuator 20 which, as best seen in FIG. 4, is comprised of a tubular coupling member 62 which is preferably of brass, and an actuator component 64 which is preferably of spring wire. More particularly, coupling 62 includes a first or upstream end 66 and a second or downstream end 68, and the upstream end is in the form of a chamber 70 facing in the upstream direction and defined by a cylindrical side wall, 72 and an inner end wall 74 transverse thereto and having an opening 76 therethrough. Preferably, downstream end 68 of tubular coupling 62 is integral with end wall 74 and is provided with a plurality of axially spaced apart circumferentially extending ribs 78 for connecting the downstream end with a flexible hose or tube of rubber or plastic during an oil draining operation as will be set forth more fully hereinafter. Valve actuator component 64 is mounted in chamber 70 and includes a U-shaped projection 80 extending in the upstream direction from wall 74 and legs 82 at the inner ends of the legs of the "U" and extending radially outwardly therefrom and thence in circumferentially opposite directions along and adjacent the inner side of wall 72 to frictionally bold the actuator component in place in chamber 70.

Figure 6:
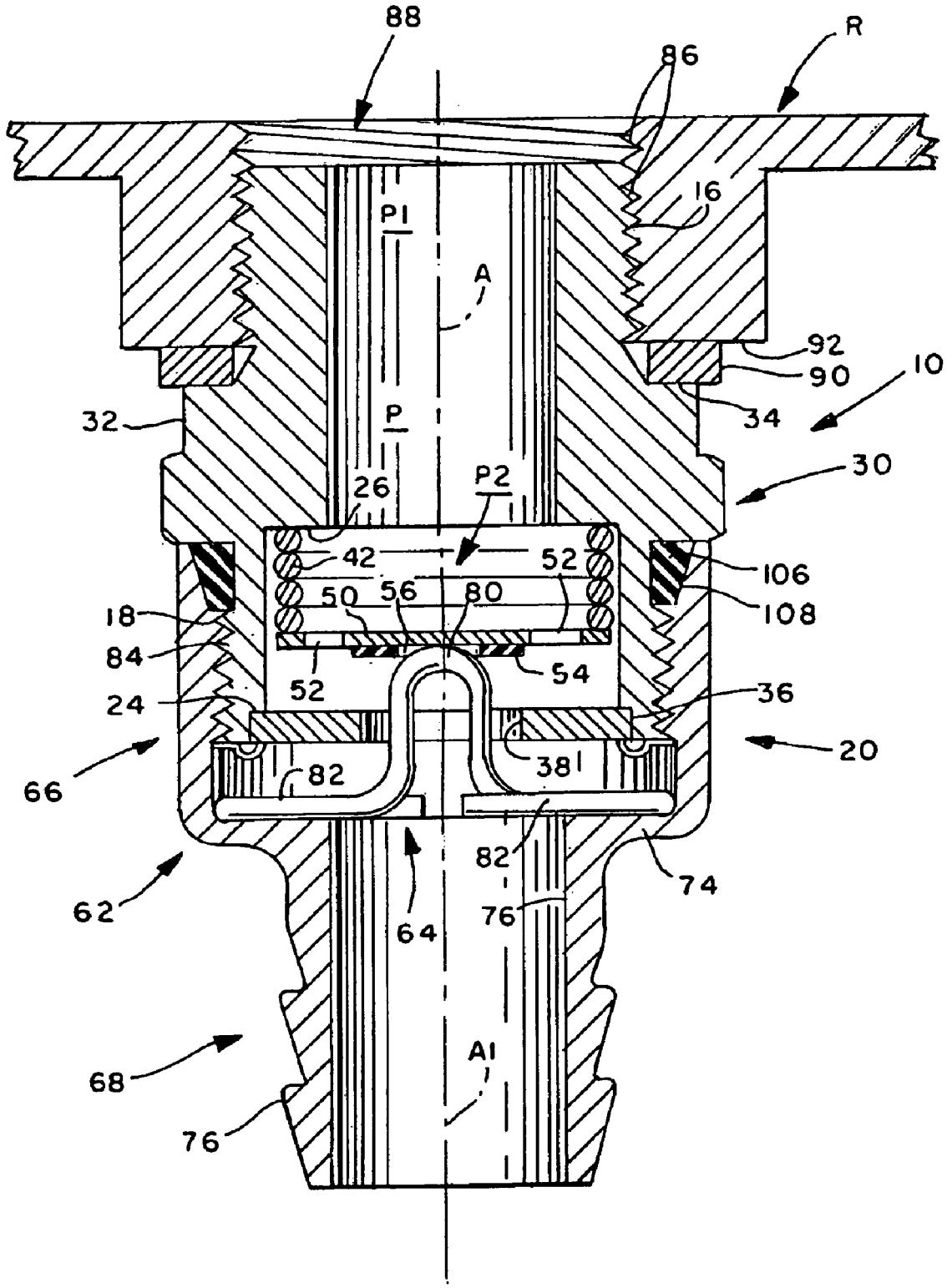

Preferably, the outer side of chamber wall 72 is knurled and the inner side thereof is provided with threads 84 which are adapted to threadedly interengage with threads 18 on the downstream end of body member 10. By threadedly interengaging threads 84 with threads 18 and rotating coupling 62 so as to move the latter in the upstream direction relative to body member 10, projection 80 moves through aperture 38 in seat plate 36 and engages the downstream side of valve disk 44 within opening 56 through sealing ring 54 and progressively displaces the valve disk upstream and away from valve seat plate 36 to open the valve, as shown in FIG. 6. The latter figure also shows threads 16 on the upstream end of body member 10 threadedly interengaged with internal threads 86 of the drain opening 88 in the bottom of an oil reservoir R such as the oil pan beneath the engine of a vehicle. It will be appreciated from FIG. 6 that opening of the valve element in the foregoing manner allows oil in reservoir R to flow through passageway P and body member 10, across arcuate openings 50 in valve disk 44 and thence through aperture 38 in seat plate 36 and into the downstream end of coupling 62 through opening 76 in the inner end wall thereof. When the fluid has been drained from reservoir R, actuator 20 is removed by rotating coupling 62 relative to body member 10 so as to progressively move the coupling in the downstream direction, whereby projection 80 of the actuator element gradually allows valve disk 44 to move downstream under the bias of spring 42 to engage seat plate 36 and close aperture 38 therethrough.

Preferably, a soft copper sealing ring 90 is interposed between shoulder 34 of the body member and the downstream end 92 of the reservoir outlet when the drain valve is mounted on the latter and, prior to such mounting, threads 16 on the upstream end of the body member are protected by a plastic end cap 94. More particularly, cap 94 has a cylindrical side wall 96 which, as will be appreciated from FIG. 5, frictionally interengages with threads 16 on the body member, and has an axially inner end 97 engaging against the upstream side of seal ring 90 to retain the latter against shoulder 34 on the body member. As will be further appreciated from FIG. 5, prior to mounting of the drain valve in a reservoir outlet as shown in FIG. 6, and during periods between oil draining operations, the downstream end of the valve is protected by end cap 22. More particularly in this respect, end cap 22 which is preferably of brass, has a cylindrical side wall 98 and an end wall 100 transverse thereto, and wall 98 is provided with internal threads 102 adapted to threadedly interengage with external threads 18 on the downstream end of body member 10 so that the end cap protects the downstream end of the body member and thus the valving assembly components from physical damage and from the ingress of dirt or other foreign matter thereinto. Preferably in this respect, the upstream end of side wall 98 has a tapered surface 104 extending inwardly and in the downstream direction, and an O-ring sealing element 106 of rubber, Viton, Neoprene, or the like extends about body member 10 adjacent the downstream side 35 of tool pad 30. Accordingly, when the end cap is screwed onto threads 18 of the body member, surface 104 engages and compresses sealing ring 106 radially and axially between the body member and end cap to seal the space therebetween. For the same purpose, as shown in FIGS. 4 and 6, the upstream end of side wall 72 of coupling 62 of the valve actuator is provided with tapered surface 108 which extends inwardly and in the downstream direction from the side wall. Accordingly, during a liquid draining operation, sealing element 106 seals the area between body member 10 and coupling wall 72 to seal against leakage of liquid thereacross or the ingress of foreign matter to the downstream end of the valve. Preferably, the outer surface of wall 98 of cap 22 is knurled to facilitate manual mounting and removal thereof from the body member. Moreover, the end cap can be tethered to the body member to preclude loss or dropping thereof when it is removed in connection with an oil draining operation.

While it is preferred to actuate the drain valve through the use of an actuator as described herein, it will be appreciated that the valve disk can, for example, be displaced upstream from the valve seat to open the valve through the use of an L-shaped tool having a leg held by the user laterally outwardly of the valve axis and a leg extending in the upstream direction which the user would push against the valve disk to displace the latter in the upstream direction. Further, with regard to the preferred actuator, the coupling portion thereof could be made of plastic or of a soft metal so as to be pushed in the upstream direction over the threads on the downstream end of the body portion so as to be frictionally held in place thereby during the draining operation. Still further, while it is preferred to provide the coupling component of the actuator with the downstream end for attachment to a drain hose, it will be appreciated that the latter portion of the coupling is not necessary to avoid oil spillage such as onto the hands of the user. In this respect, the user can screw the upstream end of the coupling onto the downstream end of the body while keeping his or her hand laterally outwardly of the axis of the coupling, whereby, when the valve opens, the liquid would flow through the opening in the inner end wall of the coupling without impinging on the person's hand. Furthermore, it will be appreciated that the resilient sealing element provided on the downstream side of the valve disk could, alternatively, be provided on the upstream side of the valve seat place about the periphery of the aperture therethrough. Likewise, it will be appreciated that the valve actuator component can be provided other than by a spring wire element as preferred. These and other modifications of the preferred embodiment will be obvious and/or suggested from the disclosure herein, whereby it is to be distinctly understood that the foregoing descriptive matter is to be interpreted merely as illustrative of the invention and not as a limitation.

Having thus described the invention, it is so claimed:

1. A liquid drain valve for a motor vehicle comprising a body member, a passageway through said body member having upstream and downstream ends with respect to the direction of flow therethrough, said body member having an upstream end for connecting the upstream end of said passageway with a source of liquid in a motor vehicle, a valve seat in said passageway between said upstream and downstream ends thereof, said valve seat having upstream arid downstream sides, a valve element on said upstream side of said valve seat and displaceable into and from engagement with said seat to respectively close and open said passageway to the flow of liquid therethrough, and said valve element being biased to engage said valve seat, said body member having a downstream end, and a valve actuator comprising a coupling member selectively engageable with said downstream end of said body member and a valve actuator element in said coupling member formed from wire and comprising a U-shaped projection extending in the upstream direction.

2. A drain valve according to claim 1, wherein said passageway has a shoulder facing downstream, and said valve seat includes an apertured plate mounted in said passageway and engaging against said shoulder.

3. A drain valve according to claim 2, wherein said valve element has upstream and downstream sides and resilient material on said downstream side engaging about the periphery of the aperture through said plate to close said passageway.

4. A drain valve according to claim 1, and resilient sealing material on one of said valve seat and said valve element.

5. A drain valve according to claim 1, wherein said coupling member has a first end progressively engageable with said downstream end of said body member in the upstream direction relative thereto, and said actuator element is in said first end for progressively displacing said valve element from engagement with said seat as said first end moves in said upstream direction.

6. A drain valve according to claim 5, wherein said downstream end of said body member and said first end of said actuator are provided with mating threads.

7. A drain valve according to claim 5, wherein said coupling member has a second end downstream of said first end for receiving a drain hose.

8. A drain valve according to claim 5, wherein said first end of said coupling member includes a chamber facing upstream of said downstream end of said body member and having an inner end wall, said actuator element being mounted in said chamber for said projection to extend upstream from said inner end wall.

9. A drain valve according to claim 8, wherein said coupling member has a conduit extending in the downstream direction from said inner end wall for receiving a drain hose.

10. A drain valve according to claim 9, wherein said downstream end of said body member and said first end of said coupling member are provided with mating threads.

11. A drain valve according to claim 1, wherein said valve seat has a circular peripheral edge and said valve element includes a disk having upstream and downstream sides, a radially inner portion overlying said peripheral edge and a radially outer portion having openings between said upstream and downstream sides, a resilient sealing material between said peripheral edge and said radially inner portion of said disk, and a spring biasing said disk to engage said valve seat.

12. A drain valve according to claim 11, wherein said sealing material is on said radially inner portion of said disk.

13. A drain valve according to claim 11, wherein said upstream end of said body portion is threaded for threaded connection with an outlet opening from a source of liquid in a motor vehicle.

14. A drain valve according to claim 13, wherein said coupling member has a first end progressively engageable with said downstream end of said body member in the upstream direction relative thereto, and said actuator element is in said first end for progressively displacing said valve element from engagement with said seat as said first end moves in said upstream direction.

15. A drain valve according to claim 14, wherein said first end of said coupling member includes a chamber facing upstream of said downstream end of said body member and having an inner end wall, said actuator element being mounted in said chamber for said projection to extend upstream from said inner end wall.

16. A drain valve according to claim 15, wherein said downstream end of said body member and said first end of said coupling member are provided with mating threads and said coupling member has a conduit extending in the downstream direction from said inner end wall for receiving a drain hose.

17. A drain valve according to claim 16, wherein said sealing material is on said radially inner portion of said disk.

18. A valve for draining liquid from a motor vehicle comprising, a body member, a circular passageway through said body member having upstream and downstream ends with respect to the direction of flow therethrough, said body member having an upstream end threaded for connection with an outlet opening from a source of liquid in a motor vehicle, said passageway including a first shoulder adjacent the downstream end thereof and a second shoulder spaced upstream from said first shoulder, each said first and said second shoulder facing downstream, an apertured plate mounted in said passageway and engaging against said first shoulder, a valve disk on the upstream side of said plate and displaceable into and from engagement with said plate to respectively close and open the aperture therethrough, and a spring between said valve disk and said second shoulder biasing said disk to engage said plate, said body member having a downstream end threaded to selectively receive one of an end cap and a valve actuator, said valve actuator comprising a coupling member having an end progressively engageable with said downstream end of said body member in the upstream direction relative thereto, and a valve actuator element in said coupling member formed from wire and comprising a U-shaped projection for progressively displacing said valve disk from engagement with said apertured plate as said end of said coupling member moves in said upstream direction.

19. A valve according to claim 17, wherein said end cap is threaded for engagement with said downstream end of said body member.

20. A valve according to claim 17, wherein said end of said includes a chamber for receiving said downstream end of said body member, said chamber having an apertured inner end wall, and said actuator element being mounted in said chamber for said projection to extend in the upstream direction.

21. A valve for draining liquid from a motor vehicle comprising, a body member, a circular passageway through said body member having upstream and downstream ends with respect to the direction of flow therethrough, said body member having an upstream end threaded for connection with an outlet opening from a source of liquid in a motor vehicle, said passageway including a first shoulder adjacent the downstream end thereof and a second shoulder spaced upstream from said first shoulder, each said first and said second shoulder facing downstream, an apertured plate mounted in said passageway and engaging against said first shoulder, a valve disk on the upstream side of said plate and displaceable into and from engagement with said plate to respectively close and open the aperture therethrough, a spring between said valve disk and said second shoulder biasing said disk to engage said plate, said body member having a downstream end threaded to selectively receive one of an end cap and a valve actuator, said valve actuator including an end progressively engageable with said downstream end of said body member in the upstream direction relative thereto, said valve actuator including an actuator element for progressively displacing said valve disk from engagement with said apertured plates as said end of said actuator moves in said upstream direction, said end of said valve actuator including a chamber for receiving said downstream end of said body member, said chamber having an apertured inner end wall, said actuator element being mounted in said chamber and including a projection extending in the upstream direction, and said actuator element being formed from wire and including a U-shaped portion providing said projection and legs frictionally engaging in said chamber to retain said actuator element therein.

22. A valve according to claim 21, wherein said aperture in said end wall opens into a conduit extending downstream from said end wall.

23. A valve according to claim 22, wherein said chamber includes a threaded inner periphery for threadedly interengaging with said downstream end of said body member.

24. A valve according to claim 18, wherein said body member has a downstream end including a peripheral skirt extending about said first shoulder, a portion of said skirt being rolled inwardly across the peripheral downstream edge of said apertured plate to hold said plate against said first shoulder.

25. A valve according to claim 18, wherein said valve disk has a downstream side facing said upstream side of said apertured plate, and a resilient sealing material between said upstream side of said apertured plate and said downstream side of said valve disk to seal against leakage through said aperture when said disk engages said plate to close said aperture.

26. A valve according to claim 25, wherein said valve disk is circular and has a central portion overlying said aperture and diametrically opposite arcuate openings therethrough radially outwardly of said central portion.

27. A valve according to claim 26, wherein said resilient sealing material is on said central portion of said disk.

28. A valve according to claim 26, wherein said body member has a downstream end including a peripheral skirt extending about said first shoulder, a portion of said skirt being rolled inwardly across the peripheral downstream edge of said apertured plate to hold said plate against said first shoulder.

29. A valve according to claim 18, wherein said body member has a downstream end and a tool pad between said upstream and downstream ends thereof, a sealing ring on said body member upstream of said tool pad, and a cap member removably mountable on said upstream end of said body member to retain said seal ring therein prior to connecting said body member with an outlet opening from a source of liquid in a motor vehicle.

30. A valve according to claim 29, wherein said sealing ring is a first sealing ring and said cap member is a first cap member, a second sealing ring on said body member downstream of said tool pad, and a second cap member removably mountable on said downstream end of said body member for engaging said second sealing ring against the downstream side of said tool pad to seal against the ingress of foreign matter to said downstream end of said body member during periods of non-use of the valve.

31. A valve according to claim 30, wherein said downstream end of said body member and said second cap member are threadedly interengageable.

32. A valve according to claim 18, wherein said end of said coupling member includes a chamber internally threaded for interengagement with the threads on said downstream end of the body member, said chamber having an apertured inner end wall opening into a conduit extending downstream from said end wall, said valve actuator element being in said chamber for said projection to extend upstream of said end wall for engaging and displacing said valve disk from engagement with said apertured plate as said coupling element is threadedly advanced onto said downstream end of said body member.

33. A valve for draining liquid from a motor vehicle comprising, a body member, a circular passageway through said body member having upstream and downstream ends with respect to the direction of flow therethrough, said body member having an upstream end threaded for connection with an outlet opening from a source of liquid in a motor vehicle, said passageway including a first shoulder adjacent the downstream end thereof and a second shoulder spaced upstream from said first shoulder, each said first and said second shoulder facing downstream, an apertured plate mounted in said passageway and engaging against said first shoulder, a valve disk on the upstream side of said plate and displaceable into and from engagement with said plate to respectively close and open the aperture therethrough, a spring between said valve disk and said second shoulder biasing said disk to engage said plate, said body member having a downstream end threaded to selectively receive one of an end cap and a valve actuator, said valve actuator including a chamber internally threaded for interengagement with the threads on said downstream end of the body member, said chamber having an apertured inner end wall opening into a conduit extending downstream from said end wall, and a valve actuator element in said chamber and including a projection extending upstream of said end wall for engaging and displacing said valve disk from engagement with said apertured plate as said valve actuator is threadedly advanced onto said downstream end of said body member, said actuator element being formed from wire and including a U-shaped portion providing said projection and legs frictionally engaging in said chamber to retain said actuator element therein.

34. A valve according to claim 18, wherein said valve disk is circular and has a central portion overlying said aperture and diametrically opposite arcuate openings therethrough radially outwardly of said central portion, said sealing material being on said central portion of said disk.

35. A valve according to claim 34, wherein said downstream end of said body member includes a peripheral skirt extending about said first shoulder, a portion of said skirt being rolled inwardly across the peripheral downstream edge of said apertured plate to hold said plate against said first shoulder.

36. A valve for draining liquid from a motor vehicle comprising, a body member, a circular passageway through said body member having upstream and downstream ends with respect to the direction of flow therethrough, said body member having an upstream end threaded for connection with an outlet opening from a source of liquid in a motor vehicle, said passageway including a first shoulder adjacent the downstream end thereof and a second shoulder spaced upstream from said first shoulder, each said first and said second shoulder facing downstream, an apertured plate mounted in said passageway and engaging against said first shoulder, a valve disk on the upstream side of said plate and displaceable into and from engagement with said plate to respectively close and open the aperture therethrough, a spring between said valve disk and said second shoulder biasing said disk to engage said plate, said body member having a downstream end threaded to selectively receive one of an end cap and a valve actuator, said valve disk being circular and having a central portion overlying said aperture and diametrically opposite arcuate openings therethrough radially outwardly of said central portion, said sealing material being on said central portion of said disk, said downstream end of said body member including a peripheral skirt extending about said first shoulder, a portion of said skirt being rolled inwardly across the peripheral downstream edge of said apertured plate to hold said plate against said first shoulder, said valve actuator including a chamber internally threaded for interengagement with the threads on said downstream end of the body member, said chamber having an apertured inner end wall opening into a conduit extending downstream from said end wall, and a valve actuator element of wire in said chamber and including a U-shaped projection extending upstream of said end wall and legs frictionally engaging said actuator element in said chamber, said projection engaging and displacing said valve disk from engagement with said apertured plate as said valve actuator is threadedly advanced onto said downstream end of said body member.

37. A valve according to claim 36, wherein said body member has a tool pad between said upstream and downstream ends thereof, a sealing ring on said body member upstream of said tool pad, and a cap member removably mountable on said upstream end of said body member to retain said sealing ring therein prior to connecting said body member with an outlet opening from a source of liquid in a motor vehicle.

38. A valve according to claim 37, wherein said sealing ring is a first sealing ring and said cap member is a first cap member, a second sealing ring on said body member downstream of said tool pad, and a second cap member removably mountable on said downstream end of said body member for engaging said second sealing ring against the downstream side of said tool pad to seal against the ingress of foreign matter to said downstream end of said foreign body member during periods of non-use of the valve.

* * * * *